US010675675B2

(12) United States Patent
Zhu et al.

(10) Patent No.: US 10,675,675 B2
(45) Date of Patent: Jun. 9, 2020

(54) WATER-COOLED MOLD FOR LOW-PRESSURE CASTING OF ALUMINUM ALLOY WHEEL

(71) Applicant: CITIC Dicastal CO., LTD., Qinhuangdao, Hebei (CN)

(72) Inventors: Lin Zhu, Qinhuangdao (CN); Changhai Li, Qinhuangdao (CN); Hongbiao Li, Qinhuangdao (CN); Baojun Shi, Qinhuangdao (CN)

(73) Assignee: CITIC Dicastal CO., LTD., Qinhuangdao, Hebei (CN)

( * ) Notice: Subject to any disclaimer, the term of this patent is extended or adjusted under 35 U.S.C. 154(b) by 0 days.

(21) Appl. No.: 16/204,003

(22) Filed: Nov. 29, 2018

(65) Prior Publication Data

US 2019/0291173 A1 Sep. 26, 2019

(30) Foreign Application Priority Data

Mar. 23, 2018 (CN) ..... 2018 1 0242568

(51) Int. Cl.

| | |
|---|---|
| ***B22D 18/04*** | (2006.01) |
| ***B22C 9/06*** | (2006.01) |
| ***B22C 9/28*** | (2006.01) |
| ***B22D 27/04*** | (2006.01) |
| ***C22C 21/00*** | (2006.01) |

(52) U.S. Cl.

CPC ..... *B22C 9/065* (2013.01); *B22C 9/28* (2013.01); *B22D 18/04* (2013.01); *B22D 27/04* (2013.01); *C22C 21/00* (2013.01)

(58) Field of Classification Search

CPC ..... B22C 9/065; B22C 9/28; B22D 18/04

See application file for complete search history.

(56) References Cited

U.S. PATENT DOCUMENTS 6,463,994 B1 * 10/2002 Nitz ..... B22C 9/28 164/137
6,986,380 B1 * 1/2006 Rice ..... B22C 9/086 164/134

FOREIGN PATENT DOCUMENTS

| | | | |
|---|---|---|---|
| CN | 106825502 A | * | 6/2017 |
| CN | 206536010 U | | 10/2017 |
| CN | 208276155 U | | 12/2018 |
| JP | H11226716 A | | 8/1999 |
| JP | 2009297739 A | | 12/2009 |
| KR | 101594739 B1 | | 2/2016 |

* cited by examiner

*Primary Examiner* — Kevin E Yoon

(74) *Attorney, Agent, or Firm* — Cooper Legal Group, LLC

(57) ABSTRACT

A water-cooled mold for low-pressure casting of an aluminum alloy wheel includes an upper mold, a lower mold and a side mold which surround a cavity of aluminum alloy, in which a cooling insert is embedded into a side mold frame of the side mold; an upper parting surface, a lower parting surface and a side parting surface of the cooling insert are respectively in contact parting with the side mold frame, the side parting surface includes a front zone and a rear straight zone, and a gap of 1.5-2.5 mm is formed between the rear straight zone and the side mold frame.

7 Claims, 5 Drawing Sheets

WATER-COOLED MOLD FOR LOW-PRESSURE CASTING OF ALUMINUM ALLOY WHEEL

CROSS-REFERENCE TO RELATED APPLICATIONS

The present application claims benefit of Chinese Patent Application No. 201810242568.2, filed on Mar. 23, 2018, the contents of which are hereby incorporated by reference in its entirety.

BACKGROUND

In the automobile part industry, the requirements for the appearance and performance of wheels as special parts, especially for the performance of spokes, are extremely stringent. In aluminum wheel enterprises, the performance of the spokes is usually improved by strengthening side mold cooling. This method is repeatedly used and effective in air-cooled molds. However, counterproductive effects often occur in water-cooled molds, and the root cause is the unreasonable design of the side mold water-cooling structure. FIGS. 1A-1B show schematic diagrams of a side mold water-cooling structure of a conventional water-cooled mold. The cooling water channel is opened downward, and the insulating groove is only opened to the window zone and is a blind hole insulating groove, which inevitably causes the side mold cooling effect to be stronger at the lower part than at the upper part, so that the shrinkage porosity easily occurs at the roots of the spokes when the side mold cooling opening time is slightly long or the flow rate is slightly large. The present disclosure will provide an improved side mold water-cooling structure to solve the current problems.

SUMMARY

The present disclosure relates to the field of low-pressure casting of aluminum alloy, and specifically, relates to a water-cooled mold for low-pressure casting of an aluminum alloy wheel.

Accordingly, the object of the present disclosure is to provide a water-cooled mold for low-pressure casting of an aluminum alloy wheel.

In one aspect of the present disclosure, provided is a water-cooled mold for low-pressure casting of an aluminum alloy wheel, the water-cooled side mold including an upper mold, a lower mold and a side mold which surround a cavity of aluminum alloy, in which a cooling insert is embedded into a side mold frame of the side mold; an upper parting surface, a lower parting surface and a side parting surface of the cooling insert are respectively in contact parting with the side mold frame, the side parting surface includes a front zone and a rear straight zone, and a gap of 1.5-2.5 mm is formed between the rear straight zone and the side mold frame; the remaining zones of the upper parting surface and the lower parting surface are 0.15-0.25 mm away from the side mold frame except 10-15 mm wide assembly zones; a cooling water channel is provided inside the cooling insert, and inlet and outlet joints are arranged at two ends of the cooling water channel.

In a preferred aspect of the present disclosure, a gap of 2 mm is formed between the rear straight zone and the side mold frame, and the remaining zones of the upper parting surface and the lower parting surface are 0.20 mm away from the side mold frame except 12 mm wide assembly zones.

In a preferred aspect of the present disclosure, the cooling insert is fixed to the side mold frame by screws.

In a preferred aspect of the present disclosure, the cooling insert is provided with blind hole insulating grooves toward spokes of the mold.

In a preferred aspect of the present disclosure, the cooling insert is provided with through hole insulating grooves toward a window of the mold.

In a preferred aspect of the present disclosure, the cooling insert includes a sealing baffle outside the cooling water channel.

In a preferred aspect of the present disclosure, the cooling water channel provided inside the cooling insert causes cooling water to flow from bottom to top.

The advantages of the present disclosure are as follows: the cooling water channel is designed into a straight channel to balance the temperature difference between the center and two sides of the side mold and reduce the thermal deformation of the mold; the 0.2 mm clearance of the upper and lower parting surfaces can control the cooling range of the side mold and improve the permeability of the mold; the cooling range of the side mold can be further controlled through the cooperation of the blind hole and through hole insulation grooves; and the water-cooling insert is embedded, which can prolong the life of the mold and reduce the cost of the mold.

BRIEF DESCRIPTION OF DRAWINGS

The embodiments of the present disclosure will be described in detail below in combination with the accompanying drawings, in which:

The present disclosure and specific embodiments will be further described below in combination with the accompanying drawings.

FIG. 1A is a cross-sectional view of a side mold, and FIG. 1B is a top view of the side mold;

FIG. 2A is a cross-sectional view of a side mold, and FIG. 2B is a top view of the side mold;

LIST OF REFERENCE SYMBOLS

Figure 1A:
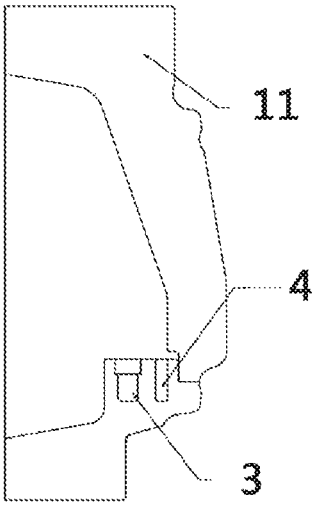
FIG. 1A (Prior Art)
FIGS. 1A-1B are schematic diagrams of a side mold water-cooling structure of a conventional water-cooled mold.
Figure 1B:
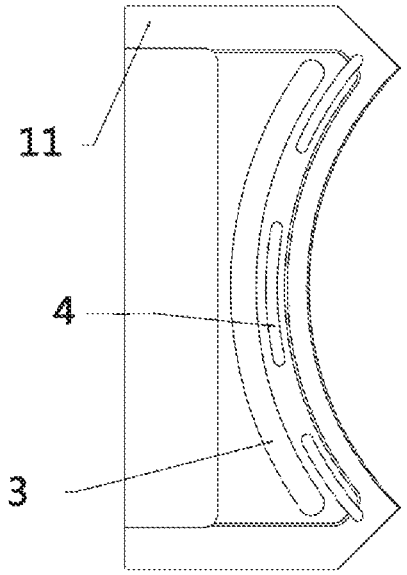
FIG. 1B (Prior Art)
Figure 2A:
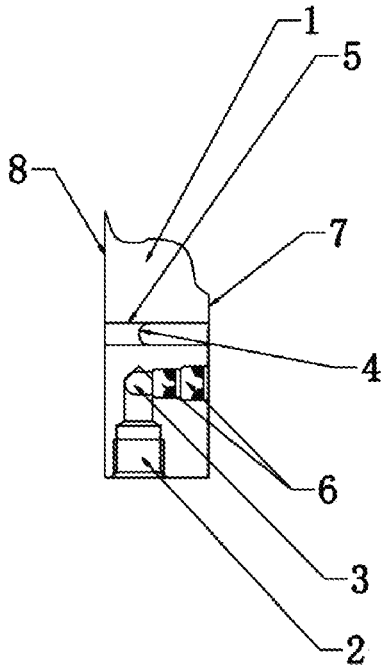
FIGS. 2A-2B are schematic diagrams of an improved side mold water-cooling structure.
Figure 2B:
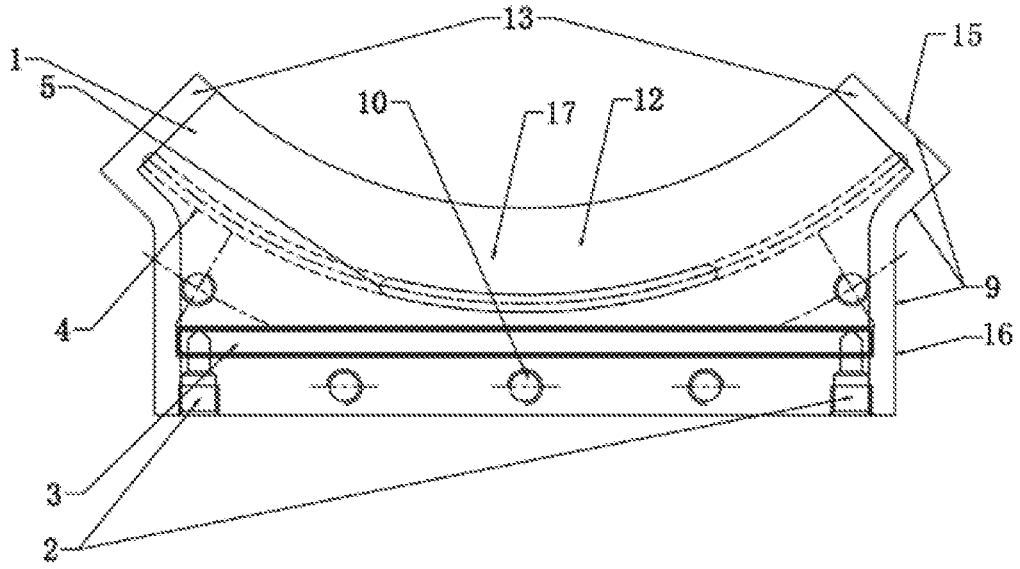
Figure 3:
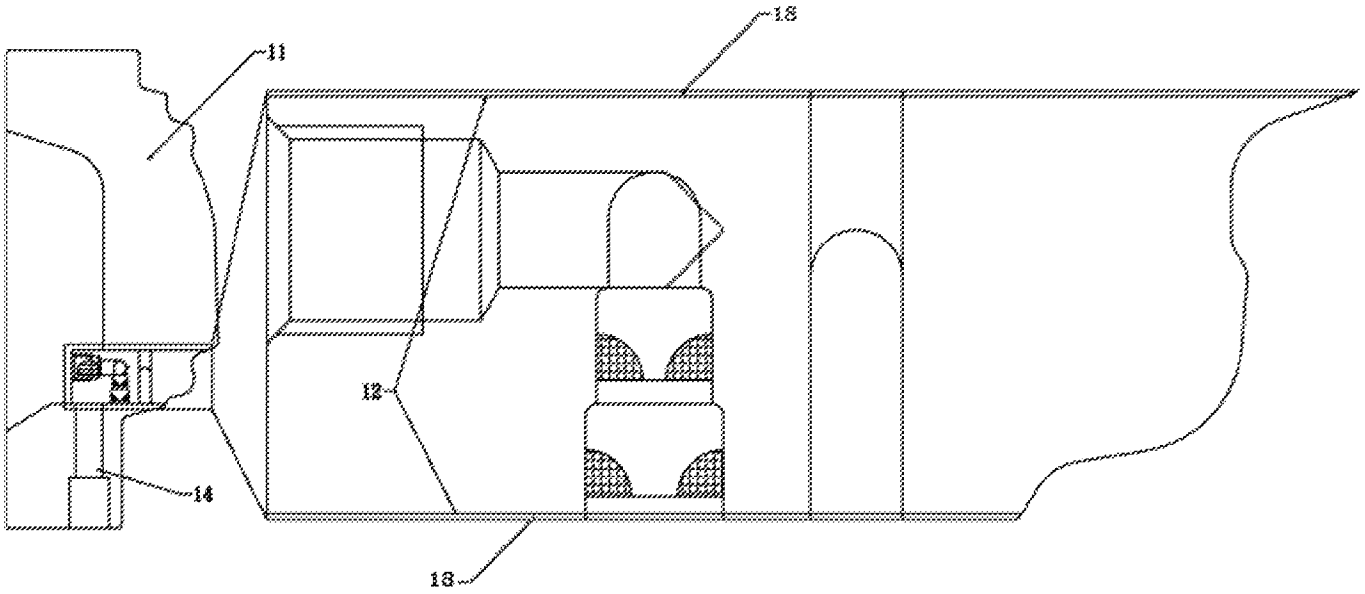
FIG. 3 is an assembly diagram of the improved side mold water-cooling structure and a partial enlarged view thereof.

1 cooling insert
2 inlet and outlet joint mounting hole
3 cooling water channel
4 blind hole insulating groove
5 through hole insulating groove
6 double sealing baffle
7 lower parting surface
8 upper parting surface
9 side parting surface
10 bolt hole
11 side mold frame
12 cooling insert clearance zone
13 assembly zone between the upper parting surface and the lower parting surface
14 through hole
15 front zone
16 rear straight zone
17 remaining zone
18 gap

DETAILED DESCRIPTION

The improved side mold water-cooling structure of the present disclosure includes a cooling insert 1 and a side mold frame 11.

First, the cooling insert 1 and the side mold frame 11 of corresponding sizes are machined in accordance with the requirements of the drawing. A 0.2 mm clearance zone 12 is machined on an upper parting surface 8 and a lower parting surface 7 of the cooling insert 1, except 10-15 mm assembly zones 13 reserved on two sides.

Then, bolt holes 10 are machined in the cooling insert 1, and through holes 14 are machined in the side mold frame 11.

Finally, a cooling water channel 3, blind hole insulating grooves 4, through hole insulating grooves 5, and a double sealing baffle 6 for sealing are machined on the cooling insert 1. The sealing baffle is snapped into the cooling water channel 3 and fixed by welding.

After the above operation is completed, the cooling insert 1 can be inserted into the side mold frame 11, and screws penetrate through the through holes 14 in the side mold frame and are screwed into the bolt holes 10 in the cooling insert 1.

The invention claimed is:

1. A water-cooled mold for low-pressure casting of an aluminum alloy wheel, the water-cooled mold comprising a side mold which surround a cavity of aluminum alloy, wherein a cooling insert is embedded into a side mold frame of the side mold; an upper parting surface, a lower parting surface and a side parting surface of the cooling insert are respectively in contact parting with the side mold frame, the side parting surface comprises a front zone and a rear straight zone, and a gap of 1.5-2.5 mm is formed between the rear straight zone and the side mold frame; zones of the upper parting surface and the lower parting surface except 10-15 mm wide assembly zones of the upper parting surface and the lower parting surface are 0.15-0.25 mm away from the side mold frame; a cooling water channel is provided inside the cooling insert, and inlet and outlet joints are arranged at two ends of the cooling water channel.

2. The water-cooled mold for low-pressure casting of an aluminum alloy wheel according to claim 1, wherein the gap between the rear straight zone and the side mold frame is 2 mm, the 10-15 mm wide assembly zones are 12 mm wide assembly zones, and the zones of the upper parting surface and the lower parting surface except the 12 mm wide assembly zones are 0.20 mm away from the side mold frame.

3. The water-cooled mold for low-pressure casting of an aluminum alloy wheel according to claim 1, wherein the cooling insert is fixed to the side mold frame by screws.

4. The water-cooled mold for low-pressure casting of an aluminum alloy wheel according to claim 1, wherein the cooling insert is provided with blind hole insulating grooves extending toward spokes of the water-cooled mold.

5. The water-cooled mold for low-pressure casting of an aluminum alloy wheel according to claim 1, wherein the cooling insert is provided with through hole insulating grooves extending toward a window of the water-cooled mold.

6. The water-cooled mold for low-pressure casting of an aluminum alloy wheel according to claim 1, wherein the cooling insert comprises a sealing baffle outside the cooling water channel.

7. The water-cooled mold for low-pressure casting of an aluminum alloy wheel according to claim 1, wherein the cooling water channel provided inside the cooling insert causes cooling water to flow from bottom to top.

* * * * *